United States Patent [19]

Takenoya et al.

[11] Patent Number: 4,522,520

[45] Date of Patent: Jun. 11, 1985

[54] DEVICE FOR ADJUSTING PRINTING PAPER TENSION IN A PRINTER

[75] Inventors: Hideaki Takenoya; Fumiyuki Mishima, both of Tokyo, Japan

[73] Assignee: Janome Sewing Machine Co. Ltd., Japan

[21] Appl. No.: 618,213

[22] Filed: Jun. 7, 1984

[30] Foreign Application Priority Data

Jun. 17, 1983 [JP] Japan ..... 58-92114

[51] Int. Cl.[3] ..... B41J 13/02

[52] U.S. Cl. ..... 400/636.1; 400/636.3; 400/641; 271/274

[58] Field of Search ..... 400/605, 636.1, 639.2, 400/639.1, 636, 636.3, 637, 637.1, 617, 638, 639, 641; 271/273, 274

[56] References Cited

U.S. PATENT DOCUMENTS

| | | | |
|---|---|---|---|
| 904,002 | 11/1908 | McCormack | 400/638 X |
| 1,534,057 | 4/1925 | Degener | 400/639.2 |
| 1,910,329 | 5/1933 | Going | 400/639.1 X |

FOREIGN PATENT DOCUMENTS

| | | | |
|---|---|---|---|
| WO83/01227 | 4/1983 | PCT Int'l Appl. | 400/617 |
| 241670 | 3/1946 | Switzerland | 271/274 |

*Primary Examiner*—Edgar S. Burr
*Assistant Examiner*—Charles A. Pearson
*Attorney, Agent, or Firm*—Michael J. Striker

[57] ABSTRACT

A device for adjusting printing paper tension in a printer comprising a switching member connected to a plurality of pinch rollers by a connecting structure whereby the pinch rollers are caused to separate from, or contact lightly or strongly with a feed roller of a printing paper feed device when the switching member is rotated, resulting in the required paper tension.

3 Claims, 4 Drawing Figures

DEVICE FOR ADJUSTING PRINTING PAPER TENSION IN A PRINTER

FIELD OF THE INVENTION

The invention relates to a device for feeding printing paper of a printer, which makes setting of the printing paper easy and enables controlling pressure to the paper to allow suitable feeding of the paper.

BACKGROUND OF THE INVENTION

The printer is fed with a printing paper which is to be printed. Unfortunately, when different types of printing paper are used, such as sprocket or plain, a different paper tension is respectively required for each type of paper in order to achieve smooth, unimpaired feeding.

SUMMARY OF THE INVENTION

With respect to the printer which is fed various types of printing paper, it is an object of this invention to provide a device which can selectively adjust paper tension as required for smooth, unimpaired feeding. Pursuant to this object, and others which will become apparent hereafter, one aspect of the invention resides in a device for adjusting printing paper tension in a printer comprising a switching member connected to a plurality of pinch rollers by a connecting structure. The connecting structure being made up of an operating member to allow adjustment of the switching member, a connecting link connecting the operating member to a rotation arm, a rotation shaft securing the rotation arm and a pressure plate, a supporting arm pivotably connected in tension to the pressure plate, a roller shaft connected to an end of the supporting arm having a plurality of pinch rollers each with a small diameter stepped portion at one end rotatably connected thereon, and a plurality of pinch roller pressing members secured to the roller shaft, each having a pressing part comprising a spring member which makes contact with the small diameter stepped portion of the pinch rollers.

As a result, rotating the switching member causes the pinch rollers to separate from, or contact lightly or strongly a feed roller of a printing paper feed device via the above mentioned connecting structure thereby providing the proper paper tension The novel features which are considered as characteristic of the invention are set forth in particular in the appended claim. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
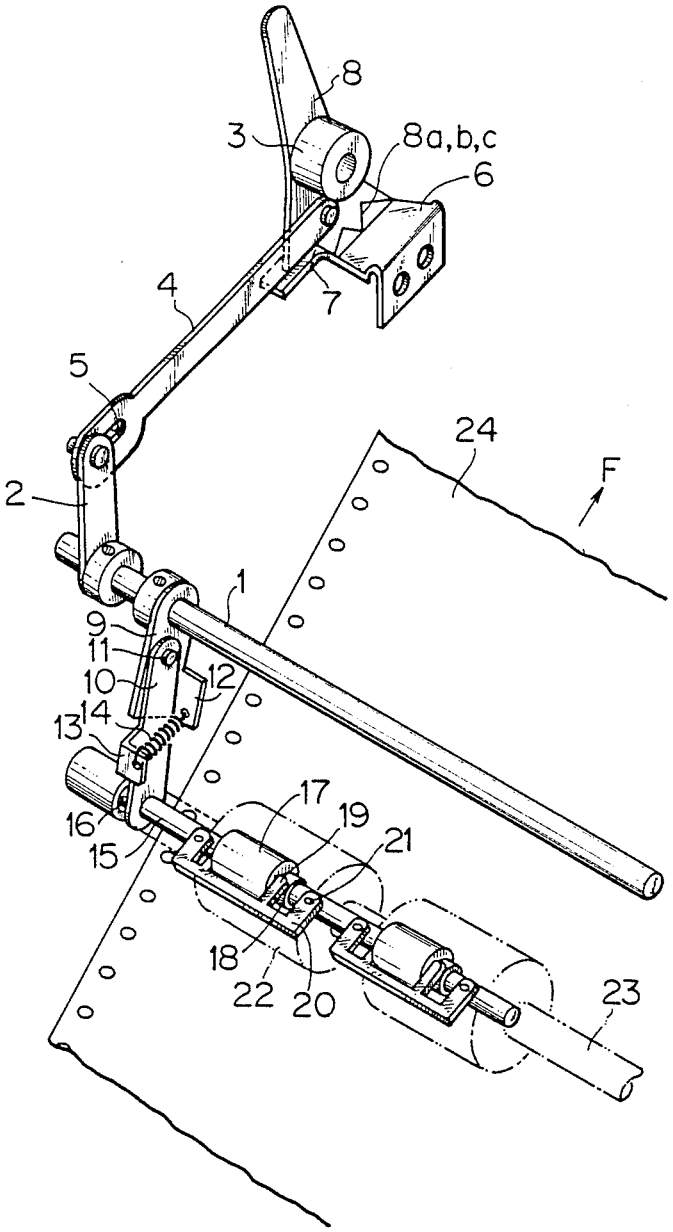
FIG. 1 is a perspective view of a main portion of the invention.

FIG. 1 is a perspective view showing an outer appearance of a main part of the invention. Inner mechanisms of a printer are protected by a machine frame (not shown).

This machine frame rotatably supports a rotation shaft 1 with a rotation arm 2 at one end, and further rotatably supports a switching member 3 via an operating member 8 which is formed with a group of engaging notches 8*a*, 8*b*, 8*c* at its a lower part. The switching member 3 is provided with a connecting link 4 connected to an end of the rotation arm 2. The link 4 has an oblong hole 5 at one end which serves to connect the connecting link 4 to the arm 2. Actuation of the rotation arm 2 by rotation of the switching member 3 will be mentioned later in connection with FIGS. 2 to 4.

A rotation stopping fixture 6 comprising a spring member which temporally and angularly stops rotation of the member 8 due to said notches 8*a*, 8*b*, 8*c* engaging with a corresponding mountain like member 7 which is formed at an end of the fixture 6.

The rotation shaft 1 is provided with pressure plates 9, 9 (one of them is not shown) in angular relation with the rotation arm 2. The pressure plate 9 is rotatably supported with a roller shaft supporting arm 10 by a pivot pin 11. At one part of the pressure plate 9 a bent part 12 is provided, and at one part of the supporting arm 10 a bent part 13 is also provided. Between these bent parts 12 and 13, a tension spring 14 is expanded, and unless a force stronger than the tension spring 14 is exerted, these members are maintained integral. The supporting arm 10 is supported with a roller shaft 15 at its end portion by a fastening part such as a nut 16.

A plurality of pinch rollers 17 are rotatably mounted upon the roller shaft 15. A small diameter portion is defined at a side of the pinch roller 17 by a step portion 18, on which a pressing part 19 of a pinch roller pressing member 20 comprising a spring member is positioned by a rivet 21.

An inner diameter of the pinch roller 17, supporting the roller shaft 15 therein is formed appropriately larger than an outer diameter of the roller shaft 15, and this roller shaft 15 is rotated together with the supporting arm 10 in order to make the action of the tension spring 14 effective.

A feed roller 22 is secured on a feed roller shaft 23 at the same position as the pinch roller 17, and said shaft 23 is rotatably supported to the machine frame.

The present device is composed as mentioned above, and if a printing paper sheet 24 is led between the pinch roller 17 and the feed roller 22, and then the printer is driven, the paper sheet 24 is fed in the direction of an arrow F by means of a paper feeding tractor (not shown).

Actuation of the present device will be explained with reference to FIGS. 2 to 4.

Figure 2:
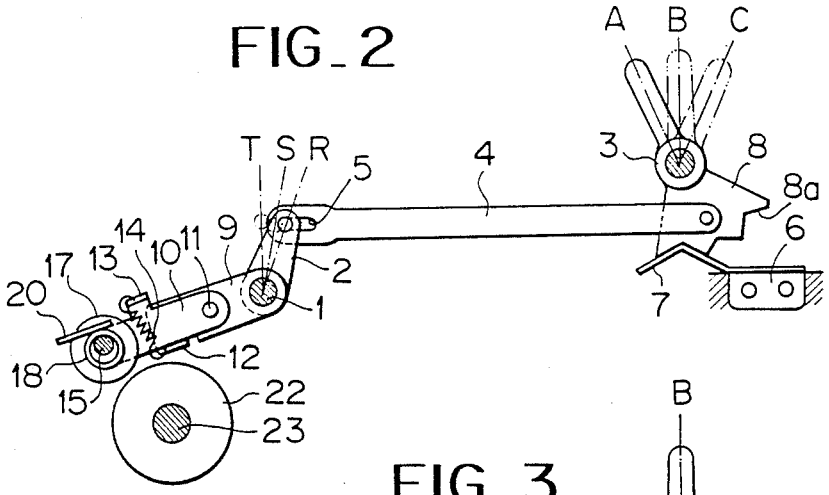
FIG. 2 is a side view of the portion of the invention in FIG. 1 showing a step of operation according to the invention.

At first, the switching member 3 of the operating member 8 is rotated to a position A in FIG. 2 against the spring action of the fixture 6, which in turn rotates the rotation arm 2 to a position R via the connecting link 4. At the same time, the pressure plate 9 is rotated in a clockwise direction together with the supporting arm 10 around the rotation shaft 1, and as a result the pinch roller 17 is separated from the feed roller 22. This condition is maintained by the mountain like member 7, so that the paper is easily set to the printer.

Figure 3:
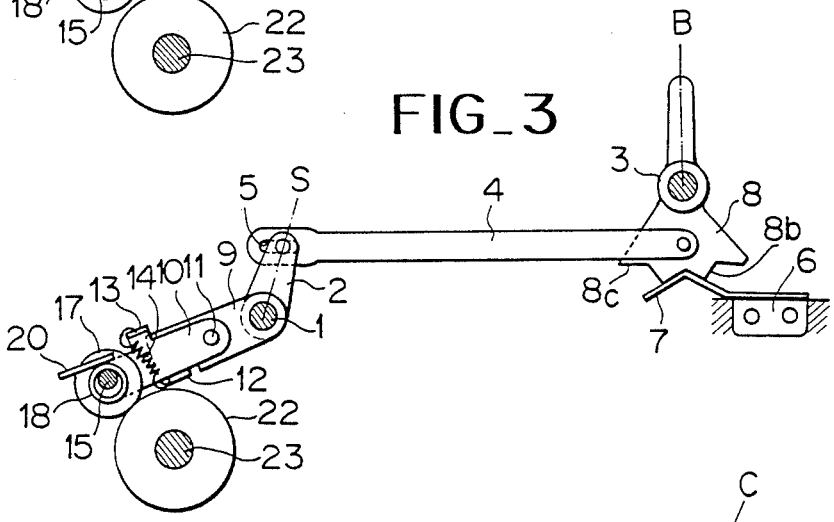
FIG. 3 is a view as in FIG. 2 showing another step of operation.

If the switching member 3 is rotated to a position B against the spring action of the fixture 6 as shown in FIG. 3, the rotation arm 2 is moved to the left via the connecting link 4, but since the hole of the connecting link 4 for holding a pin of the rotation arm 2 is oblong, the amount of leftward movement is slight, and the rotation arm 2 is stopped at a position S. Therefore, the pressure plate 9 and the supporting arm 10 are rotated in a counterclockwise direction around the rotation shaft 1, but the slight amount of rotation is to such an extent that the pinch roller 17 lightly touches the feed roller 22 due to the spring action of the pinch roller pressing part 19, as a result the plurality of the pinch rollers 17 give light tension over the printing paper sheet.

Therefore, this condition is suitable for feeding sprocket paper by driving the paper feeding tractor (not shown). The tractor exactly sends the paper by gearing pins into holes at the both ends of the sprocket paper, and the plurality of the pinch rollers give tension so light as not to cause fluttering of the printing paper sheet.

Figure 4:
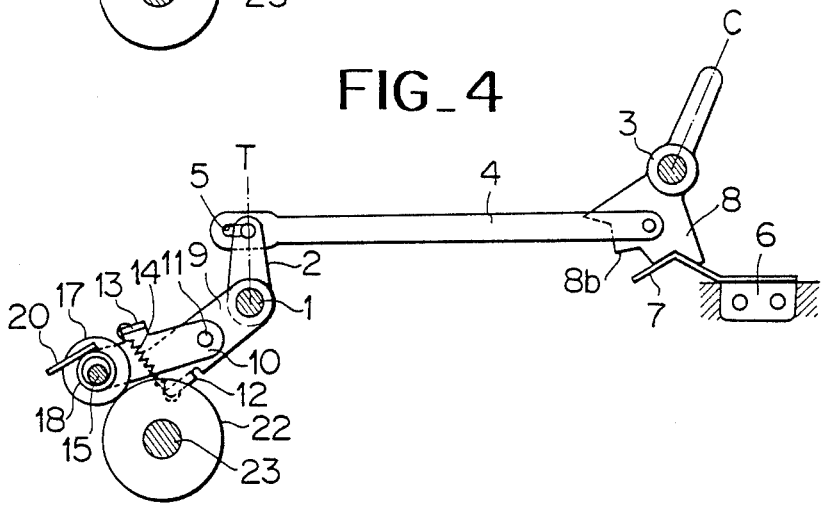
FIG. 4 is a view similar to FIG. 2 showing yet another step of operation according to the invention.

When the switching member 3 is rotated to a position C as shown in FIG. 4 against the spring action of the fixture 6, the rotation arm 2 is further moved to a position T via the link 4. Therefore, the pressure plate 9 is rotated in the counterclockwise direction around the rotation shaft 1. The supporting arm 10 is pivoted also and is rotated together with the pressure plate 9 by the spring 14, and the pinch roller 17 is mounted on the roller shaft 15 which is secured to the end portion of the supporting arm 10. Since the pinch roller 17 lightly touches the feed roller 22, the spring action of the pinch roller pressing part 19 is, if strong force is exerted, surpassed by the action of the spring 14, and the roller shaft 15 is closely contacted to a lower part of the inner diameter of the pinch roller 17 (FIG. 4), so that the bent part 12 of the pressure plate 9 is separated from the supporting arm 10.

Thus, the pinch roller 17 is urged to the feed roller 22 by the action of the tension spring 14, so that a condition is provided which is suitable for feeding paper sheet without sprocket holes.

The actuation of the present device is as mentioned above. By the simple operation of the switching member 3, it is possible to set the printing paper sheet, feed the sprocket paper sheet, and switch to feeding of paper sheet without the sprocket holes.

It will be understood that each of the elements described above, or two or more together, may also find a useful application in other types of printers differing from the types described above.

While the invention has been described and illustrated in a printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for adjusting printing paper tension in a printer, comprising:

a switching member rotatably mountable to a machine frame of the printer;

a connecting structure connected with said switching member and including a pressure plate with a supporting arm, one end of said supporting arm being pivotably mounted to said pressure plate, said supporting arm also being connected to the pressure plate by a tension spring;

a roller shaft connected to another end of the supporting arm;

a plurality of pinch rollers rotatably connected to said roller shaft, one end of each of said pinch rollers having a stepped portion, said stepped portion having a diameter smaller than the diameter of said pinch roller; and a plurality of pinch roller pressing members secured to the roller shaft, each of said pressing member having a pressing part comprising a spring member that is weaker than the tension spring and makes contact with the small diameter stepped portions of the pinch rollers, whereby the pinch rollers separate from, or contact lightly or strongly a feed roller of a printing paper feed device via said connecting structure by rotation of said switching member.

2. A device for adjusting printing paper tension as defined in claim 2, wherein said connecting structure also includes an operating member having a lower part formed with a group of engaging notches which temporally and angularly stop the switching member, a connecting link having one end connected to said operating member, another end of said connecting link being movably connected with an end of a rotation arm, said rotation arm having another end secured to a rotation shaft, said rotation shaft being rotatably supportable by the machine and secured to said pressure plate.

3. A device for adjusting printing paper tension as defined in claim 2, wherein said connecting link is formed with an oblong hole at said another end, and said one end of said rotation arm is provided with a pin for movably connecting with the oblong hole of said connecting link.

* * * * *